US007834735B2

(12) United States Patent
Iwasaki

(10) Patent No.: US 7,834,735 B2
(45) Date of Patent: Nov. 16, 2010

(54) LAMINATED COIL COMPONENT AND METHOD FOR PRODUCING THE SAME

(75) Inventor: Tomohide Iwasaki, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/484,301

(22) Filed: Jun. 15, 2009

(65) Prior Publication Data

US 2009/0243784 A1 Oct. 1, 2009

Related U.S. Application Data

(63) Continuation of application No. PCT/JP2008/050739, filed on Jan. 22, 2008.

(30) Foreign Application Priority Data

Jan. 24, 2007 (JP) ..... 2007-014159

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS 6,071,800 A 6/2000 Shigemoto et al.
6,459,351 B1 * 10/2002 Maki et al. ..... 336/200
6,515,568 B1 * 2/2003 Maki et al. ..... 336/200
7,304,557 B2 * 12/2007 Tsuzuki et al. ..... 336/200
7,375,609 B2 * 5/2008 Suzuki et al. ..... 336/200
7,474,191 B2 * 1/2009 Ito et al. ..... 336/200

FOREIGN PATENT DOCUMENTS

JP 05-029147 A 2/1993
JP 06-061079 A 3/1994
JP 06-077074 A 3/1994
JP 10-012455 A 1/1998
JP 2002-043163 A 2/2002

OTHER PUBLICATIONS

Official Communication issued in International Patent Application No. PCT/JP2008/050739, mailed on Apr. 15, 2008.

* cited by examiner

*Primary Examiner*—Anh T Mai
(74) *Attorney, Agent, or Firm*—Keating & Bennett, LLP

(57) ABSTRACT

A laminated coil component includes a laminate including laminated magnetic layers and a coil disposed in the laminate and including a plurality of internal electrodes. The number of the magnetic layers laminated in a non-superimposed area that does not overlap with the internal electrodes in the lamination direction is greater than the number of the magnetic layers laminated in a superimposed area that overlaps with the internal electrodes in the lamination direction.

9 Claims, 12 Drawing Sheets

LAMINATED COIL COMPONENT AND METHOD FOR PRODUCING THE SAME

BACKGROUND OF THE INVENTION

1. Field of the Invention

The present invention relates to a laminated coil component and a method for producing the same, and more particularly to a laminated coil component including a coil formed by laminating an electric conductor and a magnetic layer, and a method for producing the same.

2. Description of the Related Art

A laminated coil component is manufactured by repeating a process of laminating a number of ceramic green sheets on internal electrodes defining a portion of a coil and a process of pressurizing the upper surface of the ceramic green sheets to be temporary bonded, and, finally, pressure bonding a laminate obtained by laminating the ceramic green sheets.

However, there has been a problem with such a laminated coil component in that the internal electrodes may be horizontally shifted during the temporary bonding or final pressure bonding. Hereinafter, a description will be provided with reference to FIGS. 16 and 17. FIG. 16 is an exploded view of a laminate 202 of the laminated coil component. FIG. 17 is a view of a cross sectional structure of the laminate 202 after pressure bonding.

In FIG. 16, the laminate 202 is defined by alternately disposing ceramic green sheets 204 and internal electrodes 207. When the ceramic green sheets 204 and the internal electrodes 207 are alternately laminated as shown in the drawings, an area (hereinafter referred to as an area X) in which the internal electrodes 207 are arranged and an area (hereinafter referred to as an area Y) in which the internal electrodes 207 are not arranged, are arranged as viewed from above in the lamination direction. In such a case, the thickness in the lamination direction of the internal electrode-formed area X is greater than the thickness in the lamination direction of the non-internal electrode-formed area Y by the thickness of the internal electrodes 207.

When a difference occurs between the thickness of the internal electrode-formed area X and the thickness of the non-internal electrode-formed area Y as described above, a pressure applied to the internal electrode-formed area X is greater than that applied to the non-internal electrode-formed area Y when temporary pressure bonding or final pressure bonding of the ceramic green sheets 204 is performed. As a result, the pressure applied to the internal electrodes 207 in the internal electrode-formed area X escapes in the horizontal direction, which has caused a problem in that the internal electrodes 207 may be horizontally shifted in the laminate 202 as illustrated in FIG. 17.

Japanese Unexamined Patent Application Publication No. 6-61079 discloses a method for producing a laminated electronic component that solves the problem. FIG. 18 is a cross-sectional view of the laminated electronic component. According to the method for producing a laminated electronic component, the laminate 202 obtained by laminating a given number of the ceramic green sheets on which the internal electrode 207 has been printed is pressurized with hydrostatic pressure. Furthermore, as illustrated in FIG. 18, flatness of the upper surface and the lower surface of the laminated electronic component is secured by pressure bonding the ceramic green sheet 210 having good flexibility to the upper and lower sides of the laminate 202 using tools 211.

However, there has been a problem with the method for producing a laminated electronic component disclosed in Japanese Unexamined Patent Application Publication No. 6-61079 in that, since irregularities are formed on the upper and low surfaces of the laminate 202 due to the hydrostatic pressure press, the upper and low surfaces of the ceramic green sheet 210 need to be flattened by pressure bonding the ceramic green sheets 210 having good flexibility, and thus, the productivity of the laminated electronic component is greatly reduced.

SUMMARY OF THE INVENTION

To overcome the problems described above, preferred embodiments of the present invention provide a laminated coil component in which the internal electrodes are prevented from shifting when pressure bonding is performed and which can be efficiently produced, and a method for producing the same.

According to a first preferred embodiment of the present invention, a laminated coil component includes a laminate including a plurality of magnetic layers, and a coil disposed in the laminate and including a plurality of internal electrodes, in which the number of the magnetic layers laminated in a first area that are not overlapped with the internal electrodes in the lamination direction is greater than the number of the magnetic layers laminated in a second area that are overlapped with the internal electrodes in the lamination direction.

According to the first preferred embodiment of the present invention, the internal electrodes can be easily prevented from shifting in the horizontal direction. The description thereof will be provided hereinafter.

Previously, there has been a problem in that since the thickness in the lamination direction of the area in which the internal electrodes are provided is greater than the thickness of the area in which the internal electrodes are not provided, a high pressure is applied to the area in which the internal electrode are provided when pressure bonding is performed, and thus, the pressure escapes in the horizontal direction to thereby horizontally shift the internal electrodes. In order to prevent this problem, it has been proposed to uniformly apply a pressure throughout the laminate by pressurizing with hydrostatic pressure when pressure bonding the laminate, for example.

However, when the laminated coil component is produced by pressurizing by hydrostatic pressure, there has been a problem in that the productivity of the laminated electronic component is greatly because the upper and low surfaces of the laminated coil component must be flattened using the ceramic green sheets having good flexibility. Then, according to the first preferred embodiment of the present invention, an extra magnetic layer is provided in the first area in which the internal electrodes are not provided to thereby equalize the thickness of the first area and the thickness of the second area. Thus, providing an extra magnetic layer is simply performed by increasing a process of laminating the magnetic layer. Thus, the process can be easily added as compared to the pressurization with hydrostatic pressure. Therefore, according to the first preferred embodiment of the present invention, the internal electrodes can be easily prevented from shifting in the horizontal direction in the laminated coil component.

Furthermore, according to the first preferred embodiment of the present invention, since the pressure applied to the first area is approximately the same as the pressure applied to the second area, poor pressure bonding of the magnetic layer does not occur in the first area when pressure bonding the laminated coil component. As a result, delamination of the magnetic layer in the first area is prevented.

Furthermore, since the number of magnetic layers laminated in the first area is greater than the number of the magnetic layers laminated in the second area, the number of the magnetic layers laminated in the first area can be approximately the same as the total number of the magnetic layers and the number of the internal electrodes laminated in the second area. As a result, the upper surface and the lower surface of the laminated coil component can be substantially flattened, and thus, mounting failure that may occur when mounting the laminated coil component is effectively prevented.

In the first preferred embodiment of the present invention, the laminate preferably including a coil defining layer in which the internal electrodes and first magnetic layers are laminated, and non-coil-defining layers that are arranged so as to sandwich the coil forming layer from both sides in the lamination direction and that are defined by a second magnetic layer, in which the number of the second magnetic layers laminated in the second area may preferably be less than the number of the second magnetic layers laminated in the first area. Furthermore, according to the first preferred embodiment of the present invention, the second magnetic layer preferably includes a planar magnetic layer whose area is substantially the same as that of the first magnetic layer, and a partial magnetic layer whose area is less than that of the planar magnetic layer, in which the number of second magnetic layers laminated in the first area may preferably be greater than the number of the second magnetic layers laminated in the second area by providing the partial magnetic layer in the first area of the planar magnetic layer.

According to the first preferred embodiment of the present invention, the total thickness of the partial magnetic layers may preferably be substantially the same as the total thickness of the internal electrodes. When the total thickness of the partial magnetic layers is substantially equal to the total thickness of the internal electrodes, the thickness of the first area and the thickness of the second area are substantially the same. As a result, the upper surface and the low surface of the laminated coil component can be substantially flattened. According to the first preferred embodiment of the present invention, the second magnetic layer may preferably be made of the same material as the first magnetic layer. Since the first magnetic layer and the second magnetic layer are made of the same material, the adhesiveness of these layers can be increased and delamination can be more effectively prevented.

According to a second preferred embodiment of the present invention, a laminated coil component includes a laminate including a plurality of magnetic layers, and a coil disposed in the laminate and including a plurality of internal electrodes, in which the laminated coil component has a shape such that the upper surface and the low surface of the laminate are substantially flat when the lamination direction of the magnetic layer is defined as a vertical direction, the internal electrode disposed at the uppermost position curves so as to project upward in a cross section substantially parallel to the lamination direction of the laminate, and the internal electrode disposed at the lowermost position curves so as to project downward in the cross section substantially parallel to the lamination direction of the laminate.

According to the second preferred embodiment of the present invention, the internal electrodes can be easily prevented from shifting in the horizontal direction as in the first preferred embodiment of the present invention. Furthermore, delamination between the magnetic layers caused by poor pressure bonding can be effectively prevented and mounting failure during mounting of the laminated coil component can be prevented. Furthermore, according to the second preferred embodiment of the present invention, since the internal electrodes curve, the internal electrodes extend into the magnetic layers disposed above or below. As a result, delamination between the internal electrodes and the magnetic layers is more effectively prevented.

Furthermore, the internal electrode disposed at the uppermost position projects upward and the internal electrode disposed at the lowermost position projects downward. Therefore, a magnetic circuit provided in the coil can be shortened when the internal electrodes curve as compared to when the internal electrodes do not curve. As a result, the density of magnetic flux generated in the coil can be increased, thereby obtaining a large inductor.

According to a third preferred embodiment of the present invention, a laminated coil component includes a laminate including a plurality of magnetic layers, and a coil disposed in the laminate and including a plurality of internal electrodes, in which the laminated coil component has a shape such that the upper surface and the low surface of the laminate are substantially flat when the lamination direction of the magnetic layers is defined as a vertical direction, a distance from a center portion of the internal electrode disposed at the uppermost position to the upper surface of the laminate is less than a distance from both ends of the internal electrode disposed at the uppermost position to the upper surface of the laminate in a cross section substantially parallel to the lamination direction of the laminate, and a distance from a center portion of the internal electrode disposed at the lowermost position to the lower surface of the laminate is less than a distance from both ends of the internal electrode disposed at the lowermost position to the lower surface of the laminate in the cross section substantially parallel to the lamination direction of the laminate.

According to the third preferred embodiment of the present invention, the internal electrodes can be easily prevented from shifting in the horizontal direction as in the first preferred embodiment of the present invention. Furthermore, delamination between the magnetic layers due to poor pressure bonding can be prevented and mounting failure when mounting the laminated coil component can be prevented.

In the second and third preferred embodiments of the present invention, the lower surface of both ends of the internal electrodes disposed at the highest position may preferably be disposed below the upper surface of the center portion of the internal electrode disposed at a second highest position in the cross section substantially parallel to the lamination direction of the laminate and the upper surface of both ends of the internal electrode disposed at the lowest position may be disposed above the low surface of the center portion of the internal electrode disposed at a second lowest position in the cross section parallel to the lamination direction of the laminate. Or, in the second and third preferred embodiments of the present invention, the lower surface of both ends of the internal electrode disposed at the highest position may be disposed below the lower surface of the center portion of the internal electrode disposed at the highest position in the cross section substantially parallel to the lamination direction of the laminate and the upper surface of both ends of the internal electrode disposed at the lowest position may be disposed above the upper surface of the center portion of the internal electrode disposed at the lowest position in the cross section substantially parallel to the lamination direction of the laminate.

According to a fourth preferred embodiment of the present invention, a method for producing a laminated coil component that includes a laminate including first magnetic layers and second magnetic layers made of a planar magnetic layer and a partial magnetic layer and a coil that is disposed in the laminate and includes a plurality of internal electrodes, the method including forming a coil forming layer by laminating the internal electrodes and the first magnetic layers, forming the partial magnetic layer in an area on a principal surface of the planar magnetic layer and is not overlapped with the internal electrodes in a lamination direction, laminating the second magnetic layers to form a non-coil-forming layer, and pressure bonding a laminate including the coil forming layer and the non-coil-forming layer in the lamination direction.

According to the fourth preferred embodiment of the present invention, the internal electrodes can be easily prevented from shifting in the horizontal direction as in the first preferred embodiment of the present invention. Furthermore, delamination between the magnetic layers caused by poor pressure bonding can be effectively prevented and mounting failure during mounting of the laminated coil component can be easily prevented.

According to preferred embodiments of the present invention, the thickness of the first area and the thickness of the second area are preferably approximately the same by providing an extra magnetic layer in the first area in which the internal electrode is not provided, and the internal electrodes can be easily prevented from shifting in the horizontal direction.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
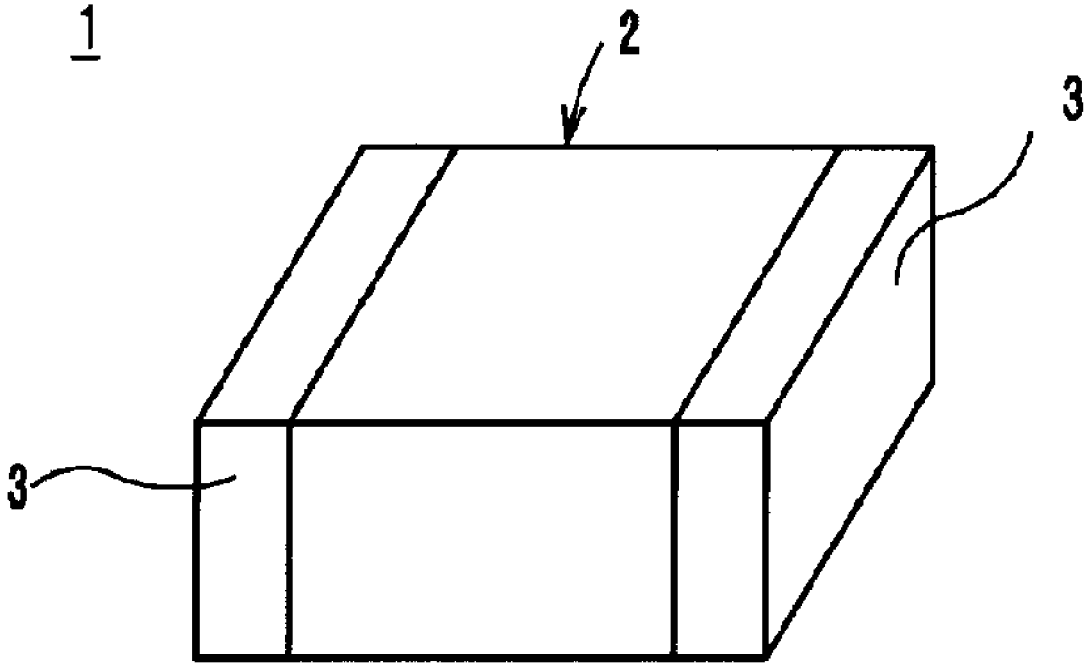
FIG. 1 is a perspective view of a laminated coil component according to a preferred embodiment of the present invention.
Figure 2:
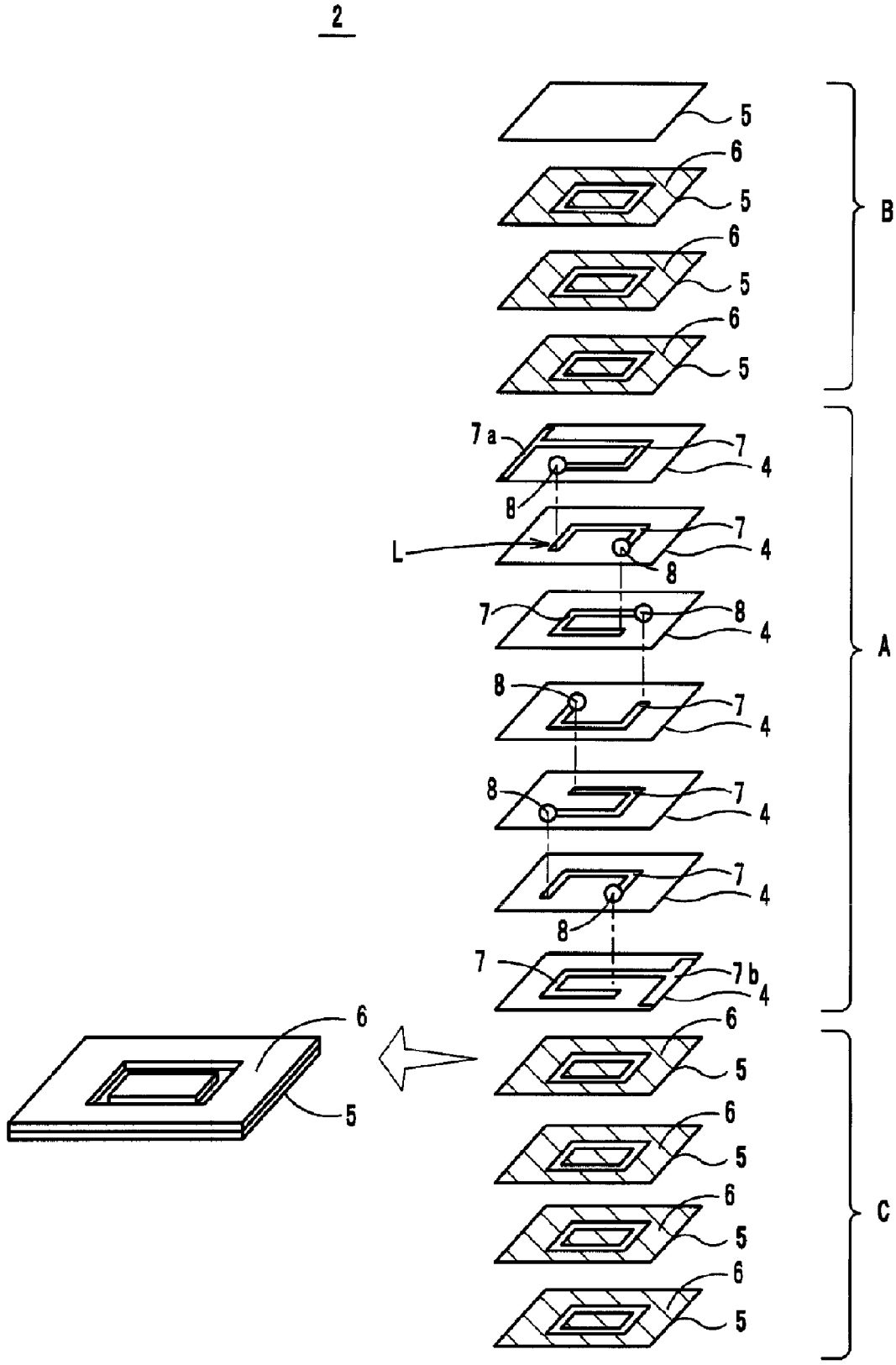
FIG. 2 is an exploded perspective view of a laminate according to a preferred embodiment of the present invention.
Figure 3:
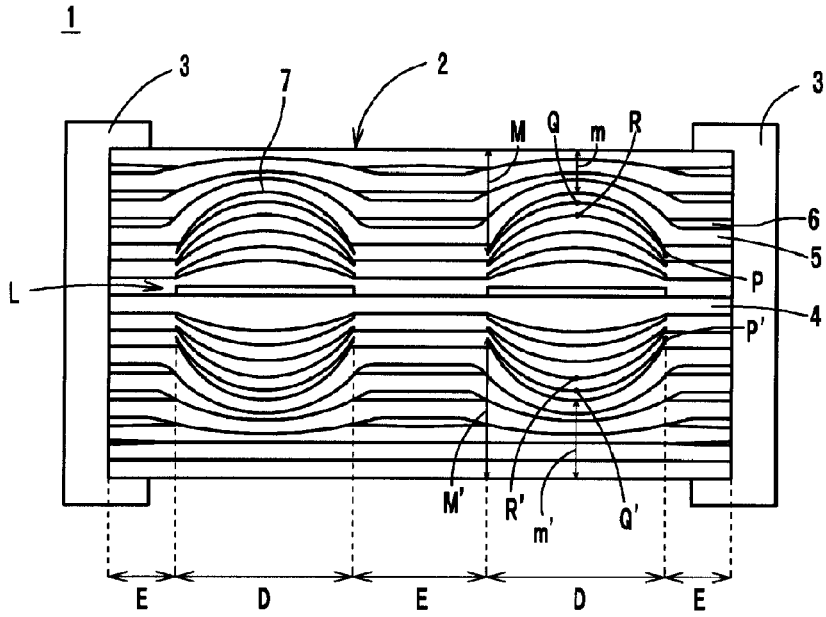
FIG. 3 is a cross sectional view of a laminated coil component according to a preferred embodiment of the present invention in a direction substantially parallel to the lamination direction.

Hereinafter, a laminated coil component according to preferred embodiments of the present invention will be described. FIG. 1 is a perspective view of a laminated coil component 1. FIG. 2 is an exploded perspective view of a laminate 2. FIG. 3 is a cross sectional view of the laminated coil component 1 in a direction substantially parallel to the lamination direction. For convenience of description, the line width of an electrode is illustrated to be proportionately larger than the actual line width. Hereinafter, the lamination direction of the laminated coil component 1 is defined as a vertical direction.

The laminated coil component 1 includes the laminate 2 in the shape of a substantially rectangular parallelepiped including a coil therein and two external electrodes 3 provided at side surfaces of the laminate 2 that face each other as illustrated in FIG. 1.

The laminate 2 is defined by laminating magnetic layers 4 and 5 made of ferrite having a high magnetic permeability (e.g., Ni—Zn—Cu ferrite or Ni—Zn ferrite) as illustrated in FIG. 2. Both of the magnetic layers 4 and 5 have the same or substantially the same area and shape. On the principal surface of the magnetic layer 4, an internal electrode 7 and via hole conductor 8 defining a coil L are provided. On a portion of the principal surface of the magnetic layer 5, a magnetic layer 6 defining a partial magnetic layer that is made of the same ferrite having a high magnetic permeability similar to the magnetic layers 4 and 5 and whose area is less than that of the magnetic layers 4 and 5 is provided. Hereinafter, a layer in which the magnetic layer 4 having the internal electrode 7 provided thereon is laminated is referred to as a coil forming layer A. Among the layers in which the magnetic layer 5 that does not include an internal electrode 7 provided thereon is laminated, a layer disposed above the coil forming layer A is referred to as a non-coil-forming layer B and a layer disposed below the coil forming layer A is referred to as a non-coil-forming layer C. More specifically, as illustrated in FIG. 2, the non-coil-forming layers B and C are arranged so as to sandwich the coil forming layer A in the vertical direction.

The internal electrode 7 is made of a conductive material preferably including Ag, for example, and has a partially cut substantially annular shape. In a preferred embodiment, the internal electrode 7 has a substantial "U" shape. Thus, one internal electrode 7 defines a portion equivalent to approximately a ¾-turn of the coil L. The internal electrode 7 may be made of a conductive material, such as a noble metal containing Pd, Au, or Pt, for example, as a main component, or an alloy thereof. The internal electrode 7 may have a partially cut substantially circular or substantially oval shape.

At one end of each internal electrode 7, a via hole conductor 8 penetrating the magnetic layer 4 in the vertical direction is provided. The adjacent internal electrodes 7 are connected with the via hole conductor 8 to define the coil L having a substantially spiral shape. The internal electrodes 7 disposed at the uppermost position and the lowermost position are provided with extraction electrodes 7*a* and 7*b*, respectively. The extraction electrodes 7*a* and 7*b* establish a connection between the coil L and the external electrodes 3.

The magnetic layer 6 is preferably formed by printing a paste-like Ni—Zn—Cu ferrite or Ni—Zn ferrite, for example, to an area (shaded area of FIG. 2) that does not overlap the internal electrodes 7 in the vertical direction. Specifically, each internal electrode 7 has a partially cut substantially annular shape and a substantially annular shape is formed by laminating the internal electrodes 7 in the vertical direction. Thus, the magnetic layer 6 is formed such that at least a portion corresponding to the substantially annular shape is a blank portion (a portion in which the magnetic layer is not formed). In a preferred embodiment, the internal electrodes 7, each having a substantially "U" shape, are laminated to each other to define a substantially square shape. Then, the magnetic layer 6 is configured so as to have a blank portion corresponding to the substantially square shape. Thus, the surface of the magnetic layer 5 has irregularities due to existence of the magnetic layer 6.

The total thickness (Number of magnetic layers 6×Thickness per magnetic layer 6) of the magnetic layers 6 is substantially equal to the total thickness (Number of internal electrodes 7×Thickness per internal electrode 7) of the internal electrodes 7. In this preferred embodiment, seven internal electrodes 7 and seven magnetic layers 6 are preferably provided, for example. Thus, in order to substantially equalize the total thickness of the magnetic layers 6 to the total thickness of the internal electrodes 7, the thickness of the internal electrode 7 and the thickness of the magnetic layer 6 are substantially equalized.

When the laminate 2 of the exploded perspective view illustrated in FIG. 2 is pressure bonded in the vertical direction and the external electrodes 3 are provided on the surface of the laminate 2, the laminated coil component 1 having the cross sectional structure illustrated in FIG. 3 is obtained. Specifically, the number of the magnetic layers 4, 5, and 6 laminated in the area that is not overlapped with the internal electrodes 7 in the vertical direction (hereinafter referred to as a non-superimposed area) is greater than the number of the magnetic layers 4 and 5 laminated in the area that overlaps with the internal electrodes 7 in the vertical direction (hereinafter referred to as a superimposed area). More specifically, the number of the magnetic layers 5 and 6 laminated in the non-superimposed area E is greater than the number of the magnetic layers laminated in the superimposed area D. Thus, the total thickness in the vertical direction of the magnetic layers 4 and 5 and the internal electrodes 7 in the superimposed area D and the total thickness of the magnetic layers 4, 5, and 6 in the non-superimposed area E are substantially equal and the upper surface and the low surface of the laminated coil component 1 are substantially flattened.

Furthermore, as illustrated in FIG. 3, the laminated coil component 1 has a shape such that at least the internal electrode 7 disposed at the highest position among the plurality of internal electrodes 7 curves so as to project upward in a cross section including the lamination direction of the laminate 2 and at least the internal electrode 7 disposed at the lowest position curves so as to project downward in a cross section including the lamination direction of the laminate 2. More preferably, the lower surface P of both ends of the internal electrode 7 disposed at the highest position is disposed below the lower surface Q of the center portion of the internal electrode 7 disposed at the highest position in the cross section substantially parallel to the lamination direction of the laminate 2 and the lower surface P' of both ends of the internal electrode disposed at the lowest position is disposed above the upper surface Q' of the center portion of the internal electrode 7 disposed at the lowest position in the cross section parallel to the lamination direction of the laminate 2.

Furthermore, as illustrated in FIG. 3, it is preferable that the lower surface P of both ends of the internal electrode 7 disposed at the highest position is disposed below the upper surface R of the center portion of the internal electrode 7 disposed at a second highest position in a cross section substantially parallel to the lamination direction of the laminate and the lower surface P' of both ends of the internal electrode 7 disposed at the lowest position be disposed above the lower surface R' of the center portion of the internal electrode disposed at a second lowest position in a cross section substantially parallel to the lamination direction of the laminate.

When the shape of the internal electrodes 7 is described in another way, it can be said that a distance m from the center portion of the internal electrode 7 disposed at the highest position to the upper surface of the laminate 2 is less than a distance M from both ends of the internal electrode 7 disposed at the highest position to the upper surface of the laminate and a distance m' from the center portion of the internal electrode 7 disposed at the lowest position to the lower surface of the laminate 2 is less than a distance M from both ends of the internal electrode 7 disposed at the lowest position to the lower surface of the laminate 2.

Furthermore, as illustrated in FIG. 3, the internal electrodes 7 have a shape such that the thickness of both ends is less than the thickness of the center portion in a cross section substantially parallel to the lamination direction of the laminate 2.

A method for producing the laminated coil component 1 according to a preferred embodiment of the present invention will be described with reference to FIGS. 4 to 11. According to the production method described below, the laminated coil component 1 is produced by a sheet lamination method. FIGS. 4 to 11 illustrate the production process of the laminated coil component 1. The ceramic green sheets 14 and 15 in FIGS. 4, 5, 6, 8, and 9 refer to unbaked layers or sheets of the magnetic layers 4 and 5 in FIGS. 2 and 3, respectively. Similarly, a ferrite printing layer 16 in FIGS. 6, 8, and 9 refers to an unbaked layer of the magnetic layer 6 in FIGS. 2 and 3.

The ceramic green sheets 14 and 15 are produced as follows. Each of about 48.0 mol % ferric oxide ($Fe_2O_3$), about 25.0 mol % zinc oxide (ZnO), about 18.0 mol % nickel oxide (Nio), and about 9.0 mol % copper oxide (CuO) is weighed and charged into a ball mill as a raw material, and subjected to a wet preparation. The obtained mixture is dried and crushed. The obtained powder is baked at about 750° C. for about 1 hour. The obtained baked powder is wet crushed with a ball mill, dried, and crushed, thereby obtaining ferrite ceramic powder.

To the ferrite ceramic powder, a binder (vinyl acetate or water-soluble acryl, for example), a plasticizer, a wetting material, and a dispersant are added, mixed in a ball mill, and then degassed by reducing pressure. The obtained ceramic slurry is formed into a sheet preferably by a doctor blade method, for example, and dried, thereby producing the ceramic green sheets 14 and 15 having a desired film thickness.

Figure 4:
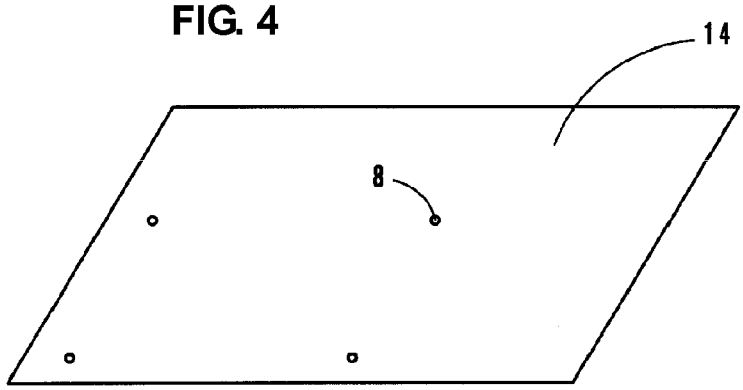
FIG. 4 is a perspective view of a ceramic green sheet according to a preferred embodiment of the present invention.

In the ceramic green sheet 14, the via hole conductor 8 arranged to connect the internal electrodes 7 of adjacent layers is formed as illustrated in FIG. 4. The via hole conductor 8 is formed by forming a through hole in the ceramic green sheet 14 using a laser beam or other suitable method, and charging the through hole with a conductive paste, such as Ag, Pd, Cu, Au, or, an alloy thereof, for example, by a printing and applying method or other suitable method.

Figure 5:
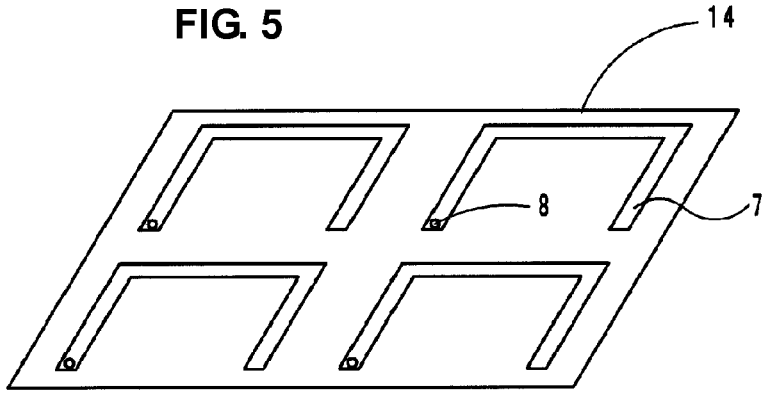
FIG. 5 is another perspective view of the ceramic green sheet according to a preferred embodiment of the present invention.

On the ceramic green sheet 14 in which the via hole conductor 8 is formed, the internal electrodes 7 are formed when a conductive paste is applied by a screen printing method, a photolithography method, or other suitable method as illustrated in FIG. 5. The internal electrode 7 is formed so as to have a substantial "U" shape preferably using Ag, Pd, Cu, Au, or an alloy thereof, for example.

Figure 6:
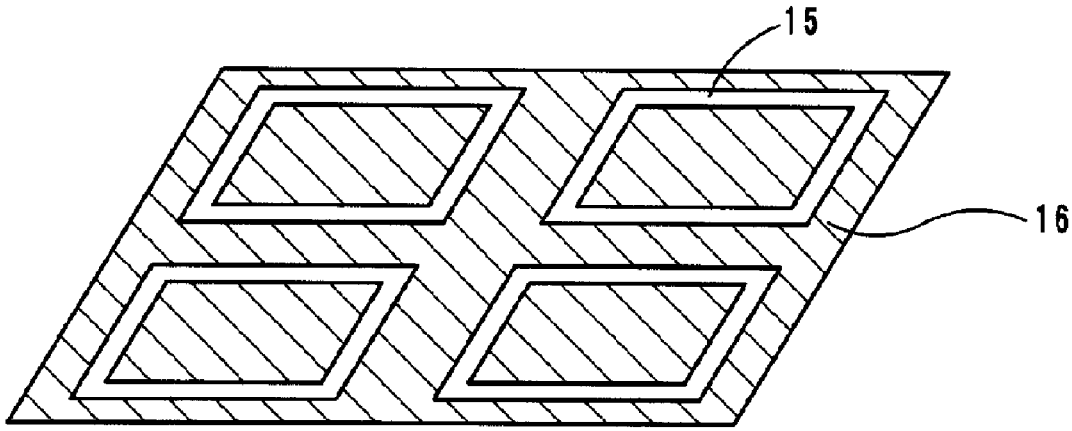
FIG. 6 is another perspective view of the ceramic green sheet according to a preferred embodiment of the present invention.

In contrast, on the ceramic green sheet 15, the printing layer 16 defining a partial magnetic layer is formed when a ferrite paste is printed by a screen printing method, for example, as illustrated in FIG. 6. The ferrite paste is preferably made of the same material as the ceramic green sheets 14 and 15. In FIG. 6, for ease of understanding, the ferrite printing layer 16 is hatched with diagonal lines. The ferrite printing layer 16 is formed in the area that does not overlap with the internal electrodes 7 illustrated in FIG. 5 in the vertical direction when the laminated coil component 1 is completed. Therefore, the ferrite printing layer 16 is formed so as to have a blank portion of a "square" shape.

Figure 7:
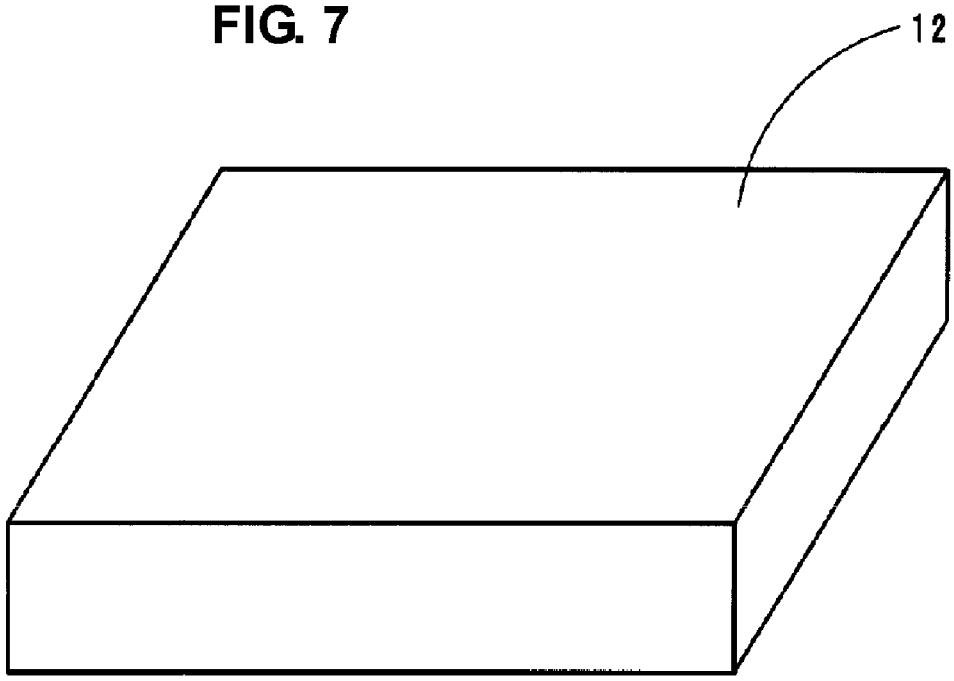
FIG. 7 is a perspective view of an unbaked mother laminate according to a preferred embodiment of the present invention.

Next, the laminate ceramic green sheets 14 and 15 are successively laminated from the bottom to form an unbaked mother laminate 12 as illustrated in FIG. 7. A description will be provided in detail with reference to FIGS. 8A to 9B.

Figure 8A:
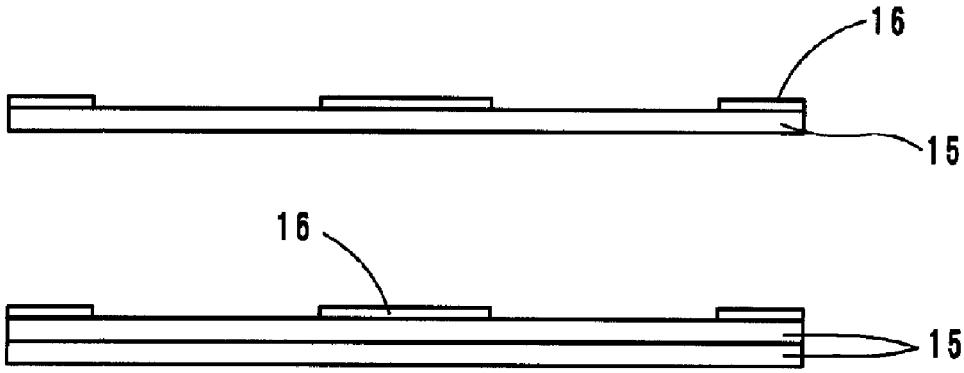
FIGS. 8A and 8B are cross sectional views illustrating a process of producing the laminated coil component according to a preferred embodiment of the present invention.
Figure 8B:
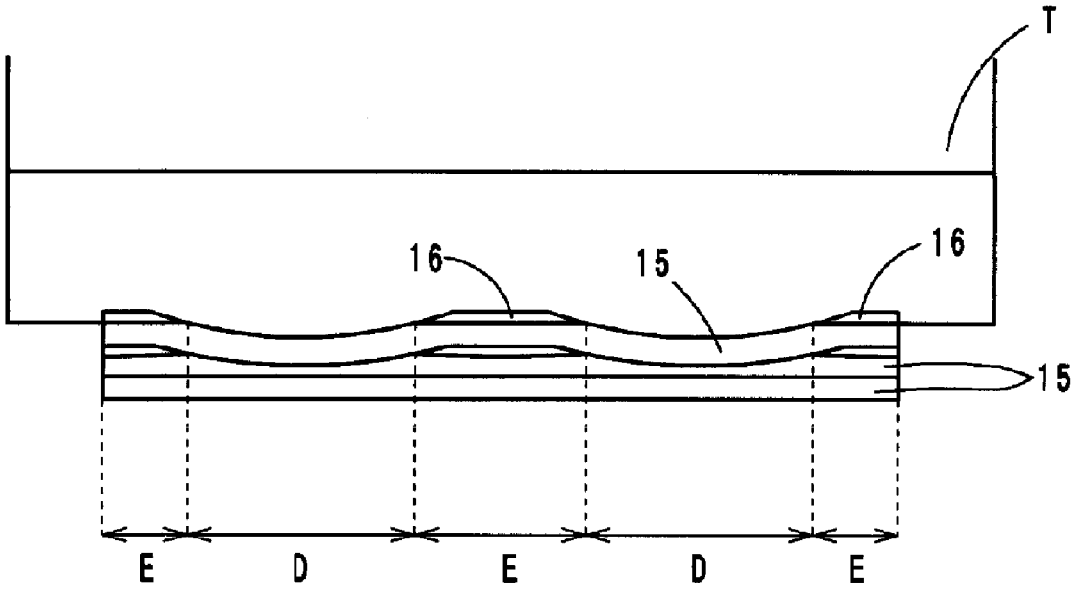

First, the ceramic green sheets 15 are repeated disposed and press bonded to form the non-coil-forming layer C illustrated in FIG. 2. Specifically, as illustrated in FIG. 8A, another ceramic green sheet 15 on which the ferrite printing layer 16 is formed is disposed on the ceramic green sheet 15 on which the ferrite printing layer 16 is formed. Then, as illustrated in FIG. 8B, the upper surface of another ceramic green sheet 15 is subjected to pressure under given conditions with a pressure bonding mold T to provide temporary pressure bonding. On the lower side of the pressure bonding mold T, a rubber sheet defined by an elastic body is formed. The processes illustrated in FIGS. 8A and 8B are repeated to thereby laminate four ceramic green sheets 15 on which the ferrite printing layer 16 is formed. Thus, the non-coil-forming layer C is obtained.

The ferrite printing layer 16 is disposed in the non-superimposed area E and the ferrite printing layer 16 is not disposed in the superimposed area D. Therefore, during lamination of the ceramic green sheet 15, the number of magnetic layers defining the superimposed area D is less than the number of magnetic layers defining the non-superimposed area E by the number of the ferrite printing layers 16. As a result, as illustrated in FIGS. 8A and 8B, the upper surface of the superimposed area D of the non-coil-forming layer C is depressed relative to the upper surface of the non-superimposed area E of the non-coil-forming layer C.

Figure 9A:
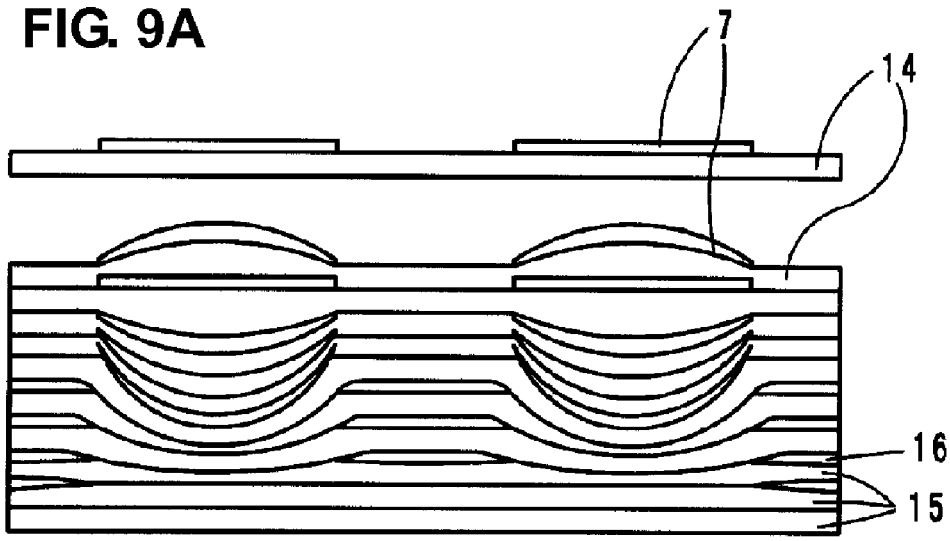
FIGS. 9A and 9B are cross sectional views illustrating the process of producing the laminated coil component according to a preferred embodiment of the present invention.
Figure 9B:
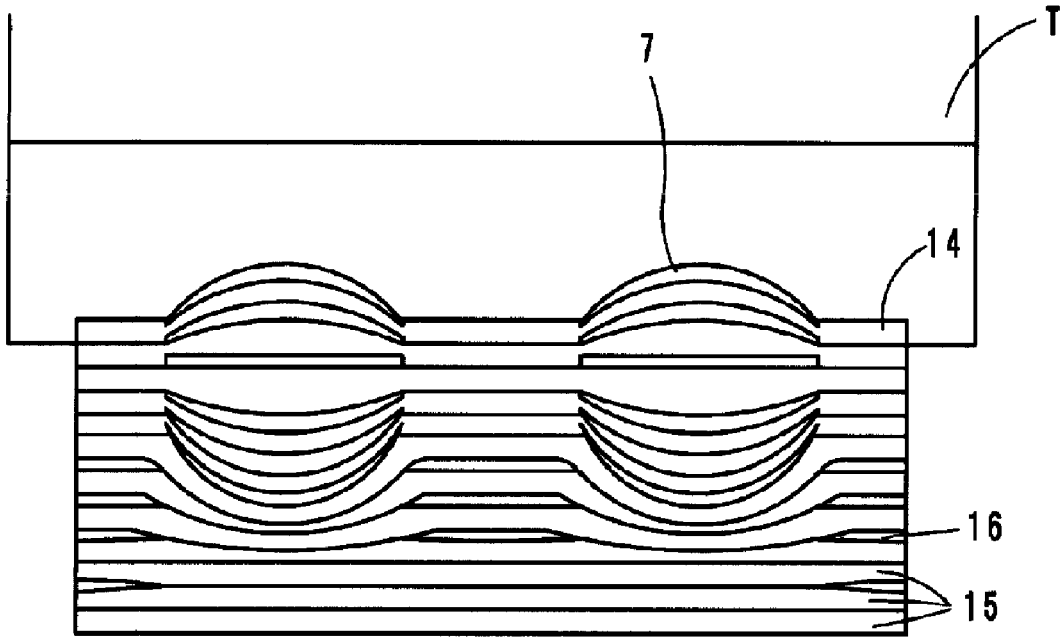

Next, the ceramic green sheets 14 are repeatedly disposed and temporarily pressure bonded on the non-coil-forming layer C to form the coil forming layer A illustrated in FIG. 2. Specifically, as illustrated in FIG. 9A, another ceramic green sheet 14 having the internal electrode 17 formed thereon is disposed on the ceramic green sheet 14. Then, as illustrated in FIG. 9B, the upper surface of another ceramic green sheet 14 is pressurized with a pressure bonding mold T to provide temporary pressure bonding. A rubber sheet is provided in substantially the same manner as in FIG. 8B. The processes illustrated in FIGS. 9A and 9B are repeated to thereby laminate seven ceramic green sheets 14 each having the internal electrode 7 formed thereon.

Here, deformation of the internal electrodes 7 during lamination of the ceramic green sheet 14 will be described. First, in the ceramic green sheets 14 of three lower layers, the internal electrodes 7 curve so as to project downward in accordance with the shape of the depression formed on the upper surface of the superimposed area D of the non-coil-forming layer C during pressurization for temporary pressure bonding. Then, since the ferrite printing layer 16 is not disposed on the ceramic green sheet 14, the depression formed on the upper surface of the superimposed area D of the non-coil-forming layer C is filled with the internal electrodes 7 for each lamination of the ceramic green sheet 14. As a result, the degree of curvature of the internal electrodes 7 on the ceramic green sheets 14 of the three lower layers is reduced in the internal electrodes 7 at a higher position. Then, as illustrated in FIG. 3, the internal electrode 7 on the ceramic green sheet 14 disposed at the center is substantially flat.

Furthermore, in the ceramic green sheets 14 of three upper layers, the center portion is forced upward by the internal electrodes 7 at lower layers so as to be curved to project upward during the pressurizing for temporary bonding pressure. Then, when being curved, both ends of the internal electrode 7 extend into the ceramic green sheet 14 disposed below. Since the internal electrode 7 is formed on the ceramic green sheet 14, a portion at which the internal electrode 7 is formed projects upward as the ceramic green sheet 14 is laminated. As a result, the degree of curvature of the internal electrodes 7 on the ceramic green sheets 14 of the three upper layers increases in the internal electrodes 7 at a higher position.

Each internal electrode 7 is extended when curved, and thus, the thickness of both ends is less than that of the center portion. Thus, the coil forming layer A is obtained in which the ceramic green sheet 14 and the internal electrode 7 are alternately laminated.

Next, lamination and temporary pressure bonding of the ceramic green sheet 15 for three layers are repeated on the coil forming layer A to form the non-coil-forming layer B illustrated in FIG. 2. As illustrated in FIGS. 9A and 9B, the upper surface of the coil forming layer A has a shape such that a portion corresponding to the superimposed area D projects upward and a portion corresponding to the non-superimposed area E is depressed. Then, the ceramic green sheet 15 on which the ferrite printing layer 16 is formed is laminated to form the non-coil-forming layer B, thereby substantially flattening the upper surface of the non-coil-forming layer B. The formation process of the non-coil-forming layer B is substantially the same as the formation process of the non-coil-forming layer C, and thus, the detailed description is omitted.

Next, by pressing the pressure bonding mold T against the unbaked mother laminate 12 including the coil forming layer A and the non-coil-forming layers B and C from above in the lamination direction under desired conditions, a pressure is applied in the vertical direction to perform final pressure bonding. Thus, the unbaked mother laminate 12 illustrated in FIG. 7 is produced.

Figure 10:
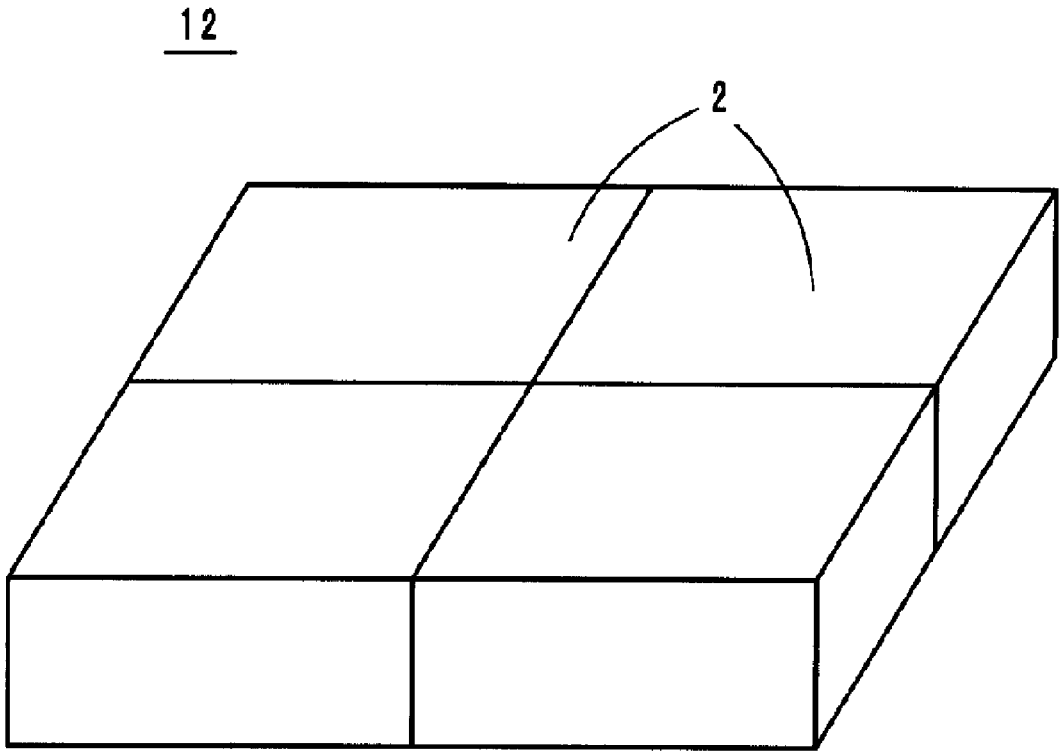
FIG. 10 is a perspective view of an unbaked mother laminate according to a preferred embodiment of the present invention.
Figure 11:
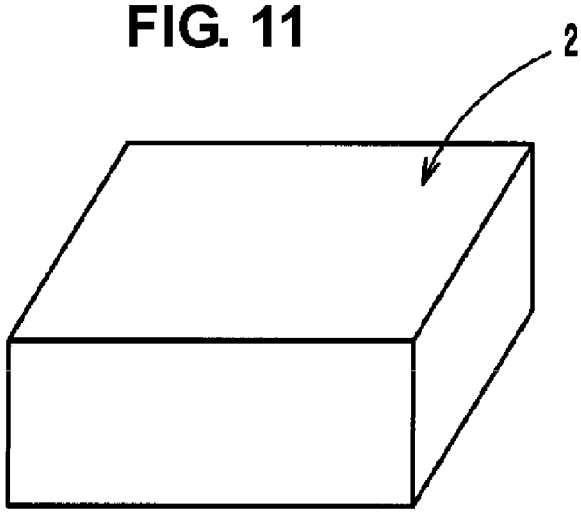
FIG. 11 is a perspective view of the laminate according to a preferred embodiment of the present invention.

Next, as illustrated in FIG. 10, the unbaked mother laminate 12 is cut into each laminate 2 by a dicer or other suitable method. Thus, the laminate 2 having a substantially rectangular parallelepiped shape as illustrated in FIG. 11 is obtained.

Next, the laminate 2 is subjected to binder removal treatment and is baked. Thus, the laminate 2 that has been baked is obtained.

Next, the external electrodes 3 are formed on the surface of the laminate 2 by applying and printing an electrode paste preferably including silver, for example, as a main component by a known method, such as dip coating, for example. The exterior electrodes 3 are formed at the right and left end surfaces of the laminate 2 as illustrated in FIG. 1. The extraction electrodes 7*a* and 7*b* of the coil L are electrically connected to the external electrodes 3.

Finally, the surface of the external electrodes 3 is preferably subjected to Ni/Sn plating or Ni/solder plating, for example. Through the processes described above, the laminated coil component 1 illustrated in FIG. 1 is completed.

As described above, according to the laminated coil component 1 and the method for producing the laminated coil component 1 of a preferred embodiment, a pressure applied to the superimposed area D and a pressure applied to the non-superimposed area E is substantially uniform when pressure bonding the laminate 2, the internal electrodes 7 are prevented from being shifted without being linearly arranged in the vertical direction. In more detail, in a laminated coil component of the related art, the thickness in the vertical direction of the non-superimposed area is less than the thickness in the vertical direction of the superimposed area. Therefore, a pressure applied to the superimposed area when pressure bonding is greater than a pressure applied to the non-superimposed area, and thus, a pressure applied to the internal electrodes escapes in the horizontal direction, which has posed a problem in that the internal electrodes are shifted in the horizontal direction.

In contrast, with the laminated coil component 1 and the method for producing the laminated coil component 1 according to a preferred embodiment, the thickness in the vertical direction of the superimposed area D and the thickness in the vertical direction of the non-superimposed area E are substantially equal, and thus, a pressure is uniformly applied to the superimposed area D and the non-superimposed area E during pressure bonding of the laminate 2. As a result, the internal electrodes 7 are prevented from being shifted without being linearly arranged in the vertical direction, and variations in electrical characteristics for each laminated coil component 1 are prevented.

Furthermore, with the laminated coil component 1 and the method for producing the laminated coil component 1 according to a preferred embodiment, the internal electrodes 7 are prevented from being shifted without being linearly arranged in the vertical direction by a relatively easy process of forming the magnetic layer 6 on the magnetic layer 5. In more detail, a process generally performed in the laminated coil component, such as screen printing, can be used for the process of forming the magnetic layer 6. Therefore, the production of the laminated coil component 1 according to a preferred embodiment does not require a special process of laminating and pressure bonding the ceramic green sheet after pressure bonding with hydrostatic pressure that has been performed in the production of the laminated coil component disclosed in Japanese Unexamined Patent Application Publication No. 6-61079. As a result, the productivity of the laminated coil component 1 is significantly increased.

Moreover, with the laminated coil component 1 and the method for producing the laminated coil component 1 according to a preferred embodiment, a pressure applied to the superimposed area D and a pressure applied to the non-superimposed area E during pressure bonding of the laminate 2 are substantially uniform, and delamination arising in the non-superimposed area E is effectively prevented. In more detail, in the laminated coil component disclosed in Japanese Unexamined Patent Application Publication No. 6-61079, the internal electrodes are not disposed in the non-superimposed area, and thus, the thickness in the vertical direction of the non-superimposed area is less than the thickness in the vertical direction of the superimposed area. Therefore, stress is concentrated on the superimposed area during pressure bonding, and thus, a sufficient pressure is not applied to the non-superimposed area. Therefore, when a sufficient pressure is not applied to the non-superimposed area, delamination is likely to occur between the magnetic layers in the non-superimposed area.

In contrast, with the laminated coil component 1 and the method for producing the laminated coil component 1 according to a preferred embodiment, the magnetic layer 6 is formed in the non-superimposed area E to equalize the thickness in the vertical direction of the superimposed area D and the thickness in the vertical direction of the non-superimposed area E. Therefore, a pressure is uniformly applied to the superimposed area D and the non-superimposed area E during pressure bonding of the laminate 2. As a result, delamination between the magnetic layers 4, 5, and 6 in the non-superimposed area E of the laminated coil component 1 is prevented.

With the laminated coil component 1 and the method for producing the laminated coil component 1 according to a preferred embodiment, the magnetic layer 6 is provided in the area in which the internal electrode 7 is not disposed so that the thickness in the vertical direction of the superimposed area D is substantially equal to the thickness in the vertical direction of the non-superimposed area E. Therefore, the upper surface and the low surface of the laminated coil component 1 can be substantially flattened, and mounting failure during mounting of the laminated coil component 1 on a substrate is greatly reduced.

In the laminated coil component 1, the internal electrodes 7 have a curved shape, and thus, the internal electrodes 7 extend into the magnetic layers 4. As a result, a force which prevents separation of the internal electrodes 7 and the magnetic layer 4 acts therebetween, thereby effectively preventing delamination. Furthermore, since the internal electrodes 7 have a shape in which the ends are narrower than the center portion and are pointed, the ends of the internal electrode 7 extend into the magnetic layer 4.

Furthermore, in to the laminated coil component 1, the magnetic layers 4, 5, and 6 are made using the same material, and this, the adhesiveness between the layers is very high. As a result, delamination occurring in the laminated coil component 1 can be effectively prevented. When the magnetic layers 4, 5, and 6 are made of materials having the same or substantially the same shrinkage during baking, delamination is even more effectively prevented.

Figure 12A:
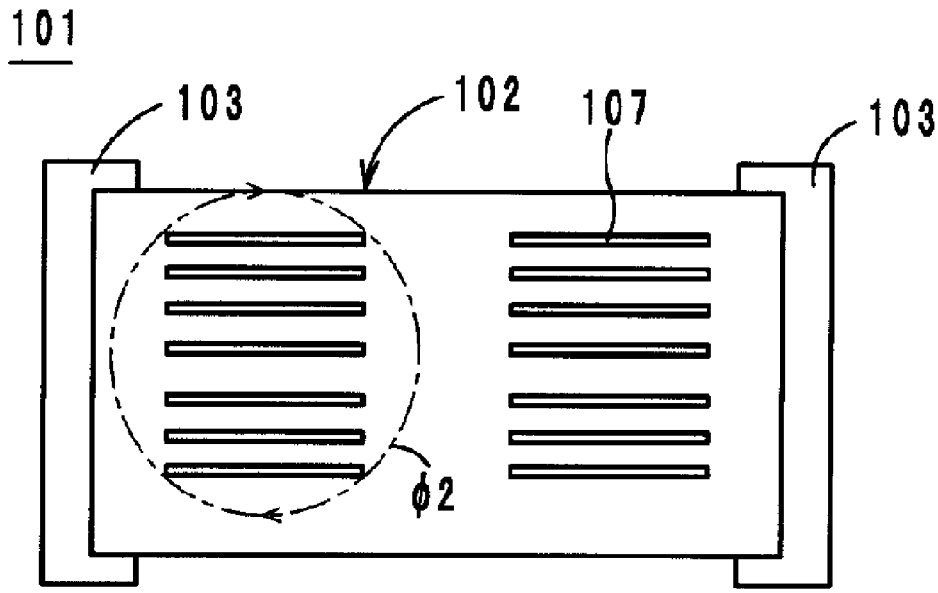
FIGS. 12A and 12B are views illustrating the state of a magnetic circuit in the laminated coil component according to a preferred embodiment of the present invention.
Figure 12B:
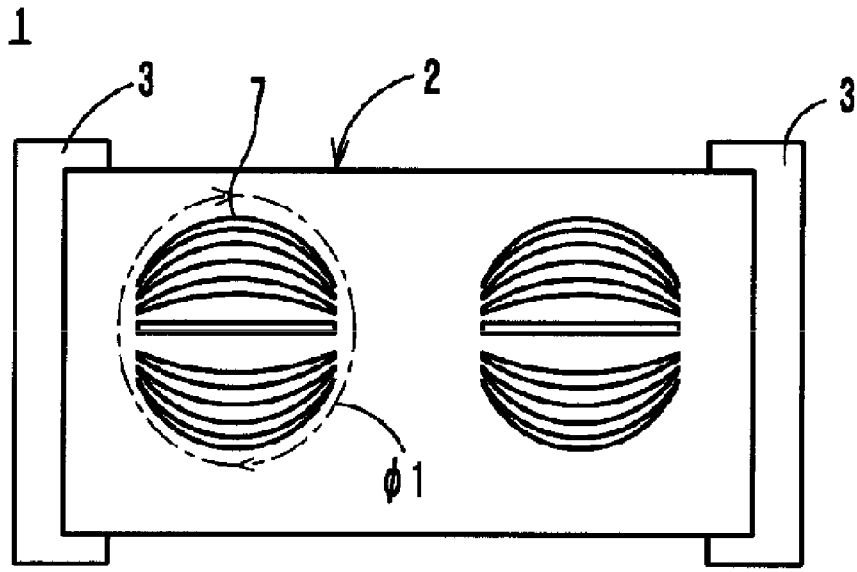

Furthermore, in the laminated coil component 1, since the internal electrode 7 disposed at the highest position in the lamination direction projects upward and the internal electrode 7 disposed at the lowest position in the lamination direction projects downward, the inductance of the laminated coil component 1 can be increased. Hereinafter, a description will be given with reference to FIGS. 12A and 12B. FIG. 12A is a cross section of a laminated coil component 101 of a comparative example and FIG. 12B is a cross section of the laminated coil component 1 according to a preferred embodiment.

The laminated coil component 101 illustrated in FIG. 12A includes internal electrodes 107 that are not curved. In contrast, the laminated coil component 1 illustrated in FIG. 12B includes an internal electrode 7 disposed at the highest position in the lamination direction that projects upward and an internal electrode 7 disposed at the lowest position in the lamination direction that projects downward. In the laminated coil component 1, the outer circumference of the internal electrode row is reduced because the corners of the internal electrodes 7 disposed at the highest position and the lowest position are not present. Therefore, the magnetic circuit $\phi$1 of the laminated coil component 1 is reduced as compared to the magnetic circuit $\phi 2$ of the laminated coil component 101 of the comparative example. As a result, the magnetic flux of the laminated coil component 1 can be increased, which enables an increase in inductance of the laminated coil component 1.

Figure 13:
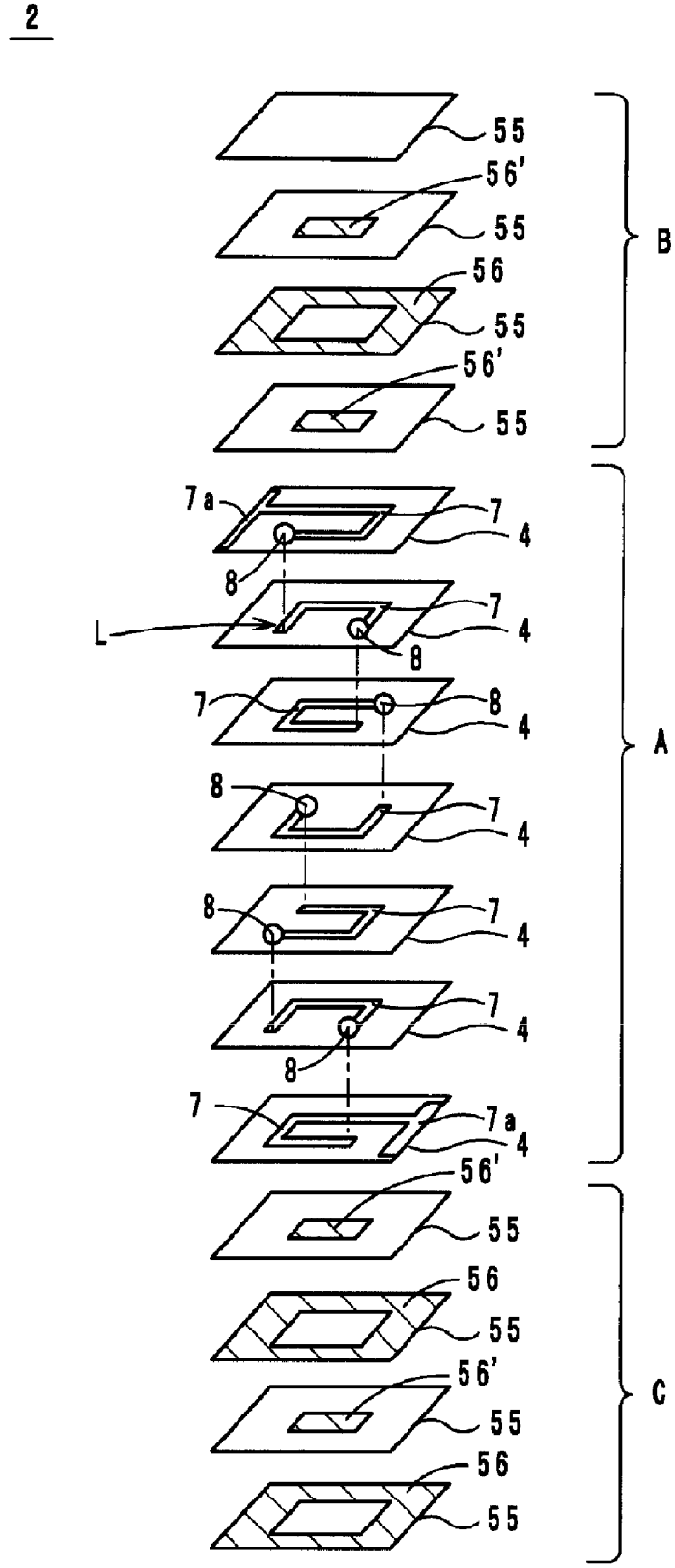
FIG. 13 is an exploded perspective view of a laminate of a laminated coil component according to another preferred embodiment of the present invention.

In the laminated coil component 1, the magnetic layer 6 is configured to have a substantially annular blank portion corresponding to the internal electrode 7 as illustrated in FIG. 2. However, the shape of the magnetic layer 6 is not limited thereto. As illustrated in FIG. 13, a magnetic layer 55 in which a magnetic layer 56 is provided only in an area surrounding an area around the internal electrode 7 and the magnetic layer 55 in which a magnetic layer 56' is provided only in an area inside the internal electrode 7 may be alternately laminated. In this case, it is preferable that each of the magnetic layers 56 and 56' have a thickness about twice that of the internal electrode 7.

Figure 14:
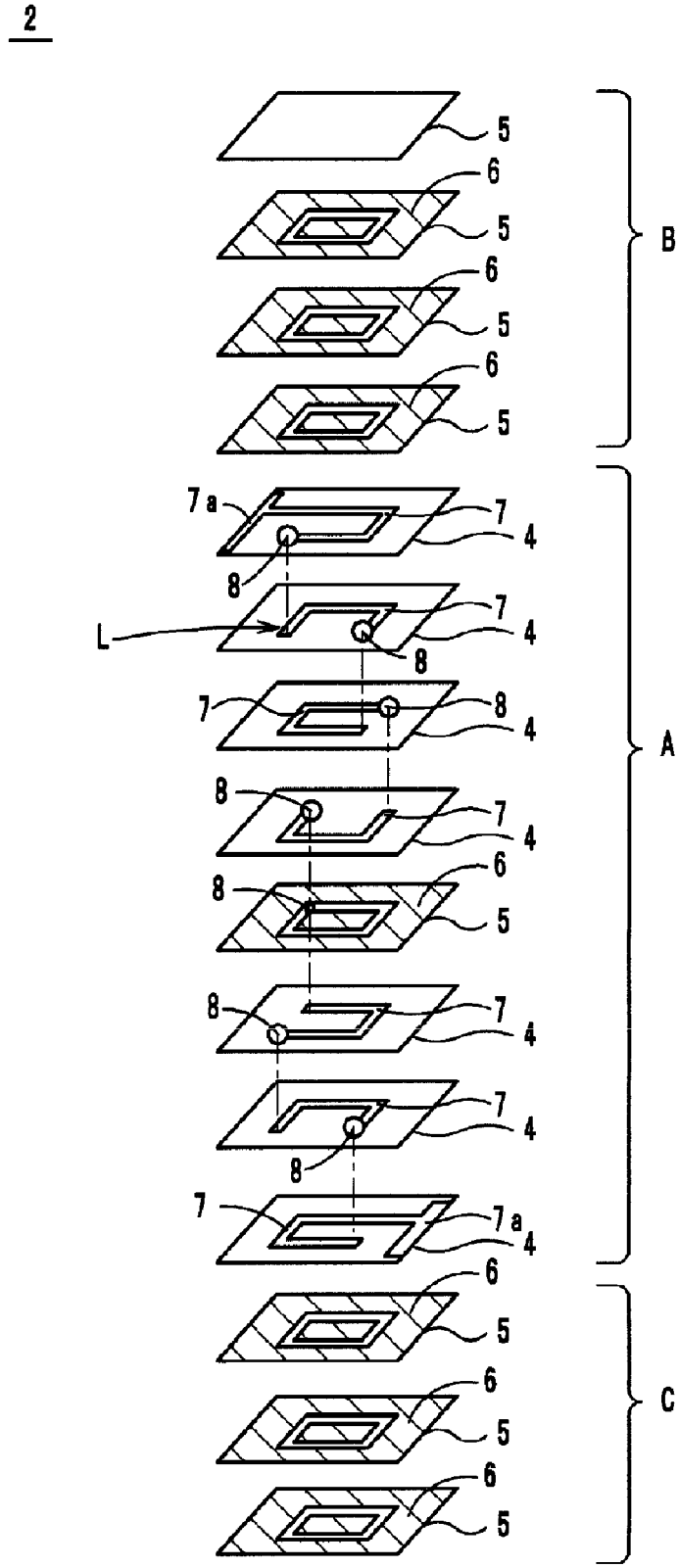
FIG. 14 is an exploded perspective view of a laminate of a laminated coil component according to another preferred embodiment of the present invention.

In the laminated coil component 1, the magnetic layer 6 is provided on the magnetic layer 5 of the non-coil-forming layers B and C. However, a location at which the magnetic layers 5 and 6 are provided is not limited thereto. For example, as illustrated in FIG. 14, the magnetic layer 5 on which the magnetic layer 6 is provided may be arranged near the center in the vertical direction of the coil forming layer A. In this case, the via hole conductor 8 to connect the internal electrodes 7 provided in the upper and lower layers is disposed in the magnetic layer 5.

Figure 15:
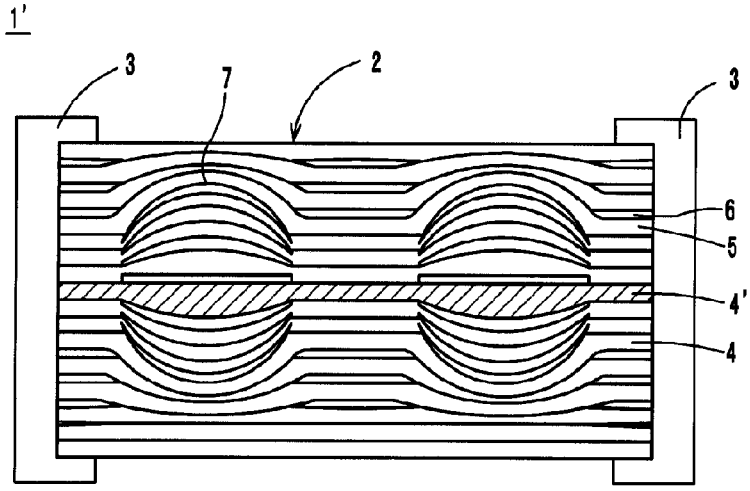
FIG. 15 is a view of a cross sectional structure of the laminated coil component according to another preferred embodiment of the present invention.
Figure 16:
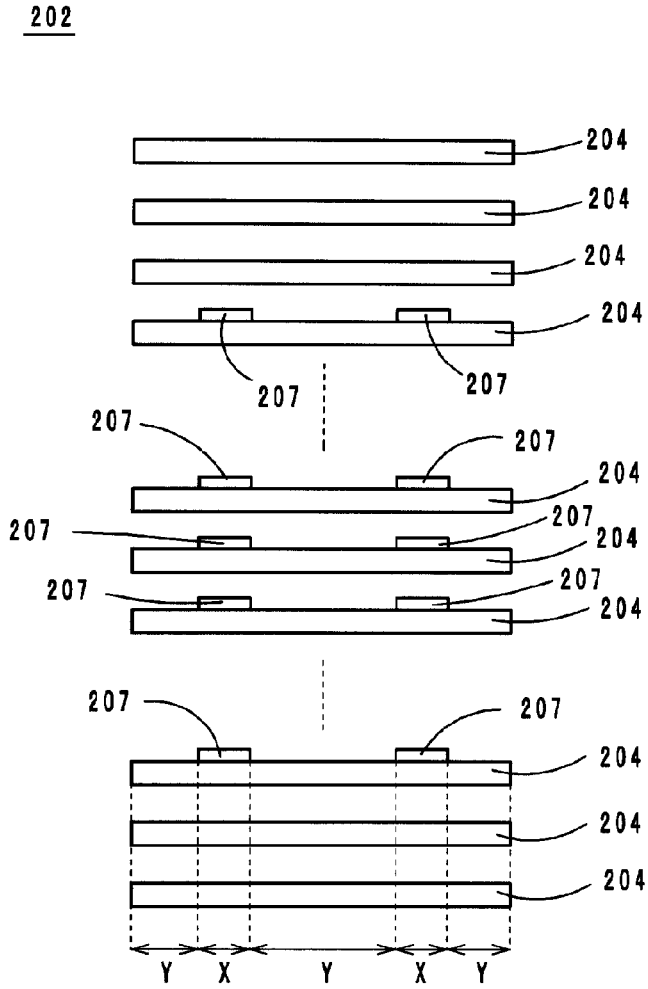
FIG. 16 PRIOR ART
FIG. 16 is an exploded view of a laminate of a laminated coil component of the related art.
Figure 17:
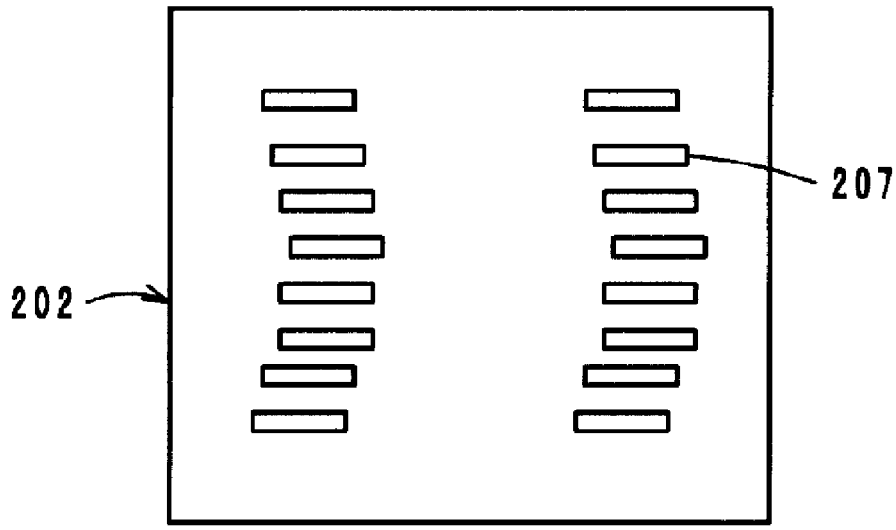
FIG. 17 PRIOR ART
FIG. 17 is a cross sectional view of the laminate shown in FIG. 16 after pressure bonding.
Figure 18:
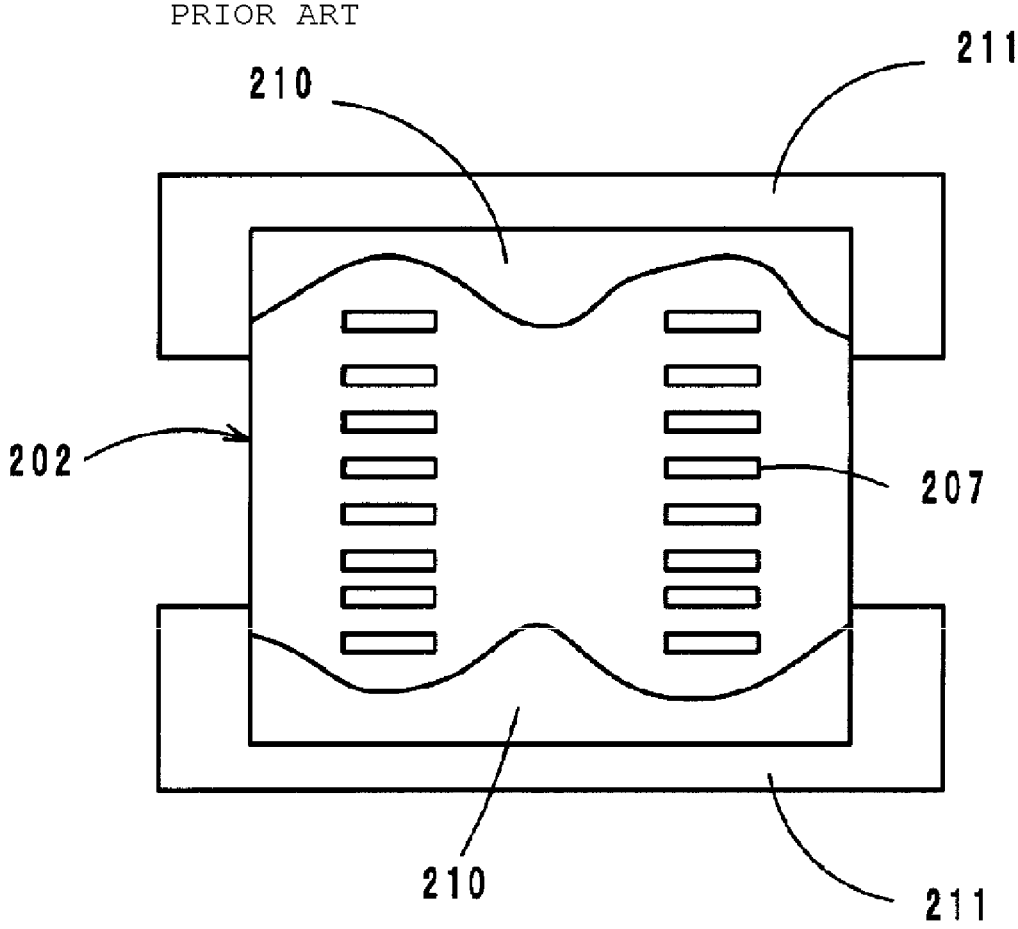
FIG. 18 PRIOR ART
FIG. 18 is a cross sectional view of another laminated coil component of the related art.

All of the magnetic layers 4 of the laminated coil component 1 are preferably made of the same material. However, the magnetic layers 4 need not necessarily be made of the same material. For example, a low permeability layer 4 made of a low permeability material may be provided in the laminate 2 as in the laminated coil component 1' illustrated in FIG. 15. In this case, the magnetic resistance in the low permeability layer 4' of the magnetic circuit disposed surrounding the coil L is increased, and the magnetic flux leaks in the low permeability layer 4'. Therefore, magnetic saturation is not likely to occur, and a significant reduction in inductance due to the development of magnetic saturation is prevented. More specifically, the laminated coil component 1' having outstanding direct current superimposed characteristics is obtained. The low permeability layer 4' may be made of a material whose magnetic permeability is low compared to the magnetic layer 4 or a nonmagnetic material.

A sheet lamination method has been described as an example of the method for producing the laminated coil component 1. However, the method for producing the laminated coil component 1 is not limited thereto. For example, the laminated coil component 1 may be produced by a sequential printing lamination method or a transfer lamination method.

In the laminated coil component 1, the number of internal electrodes 7 and the number of magnetic layers 6 preferably are equal, for example. However, the numbers thereof need not necessarily be equal to each other, as long as the total thickness of the magnetic layers 6 is substantially equal to the total thickness of the internal electrodes 7. Therefore, for example, when the thickness of the magnetic layer 6 is about half the thickness of the internal electrode 7, the number of magnetic layers 6 is twice the number of internal electrodes 7. It is preferable that the total thickness of the magnetic layers 6 and the total thickness of the internal electrodes 7 are substantially equal, but the thicknesses may not necessarily be substantially equal. There may be a difference in the thickness therebetween insofar as a problem resulting from a difference in thickness between the superimposed area D and the non-superimposed area E does not arise.

The laminated coil component according to the present invention is not limited to the preferred embodiments described above, and can be changed within the scope.

As described above, preferred embodiments of the present invention are useful for a laminated coil component and a method for producing the same and are excellent in that the internal electrodes can be prevented from shifting during pressure bonding and the laminated coil component is efficiently produced.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A laminated coil component, comprising:

a laminate including laminated magnetic layers; and a coil disposed in the laminate and including a plurality of internal electrodes; wherein a number of the magnetic layers laminated in a first area that does not overlap with the plurality of internal electrodes in a lamination direction is greater than a number of the magnetic layers laminated in a second area that overlaps with the plurality of internal electrodes in the lamination direction.

2. The laminated coil component according to claim 1, wherein the laminate comprises:

a coil forming layer in which the plurality of internal electrodes and first magnetic layers of the magnetic layers are laminated; and non-coil-forming layers disposed so as to sandwich the coil forming layer on both sides in the lamination direction and including second magnetic layers of the magnetic layers; wherein a number of the second magnetic layers laminated in the second area is less than a number of the second magnetic layers laminated in the first area.

3. The laminated coil component according to claim 2, wherein the second magnetic layers include a planar magnetic layer having an area substantially the same as that of the first magnetic layer and a partial magnetic layer having an area less than that of the planar magnetic layer; and the number of the second magnetic layers laminated in the first area is greater than the number of the second magnetic layers laminated in the second area by providing the partial magnetic layer in the first area of the planar magnetic layer.

4. The laminated coil component according to claim 3, wherein a total thickness of the partial magnetic layers is substantially the same as a total thickness of the internal electrodes.

5. The laminated coil component according to claim 2, wherein the second magnetic layers are made of the same material as the first magnetic layers.

6. A laminated coil component, comprising:

a laminate including laminated magnetic layers; and a coil disposed in the laminate and including a plurality of internal electrodes; wherein an upper surface and a lower surface of the laminate is substantially flat where a lamination direction of the magnetic layer is defined as a vertical direction;

a distance from a center portion of the internal electrode disposed at the highest position to the upper surface of the laminate is less than a distance from both ends of the internal electrode disposed at the highest position to the upper surface of the laminate in a cross section substantially parallel to the lamination direction of the laminate; and a distance from a center portion of the internal electrode disposed at the lowest position to the lower surface of the laminate is less than a distance from both ends of the internal electrode disposed at the lowest position to the lower surface of the laminate in the cross section substantially parallel to the lamination direction of the laminate.

7. The laminated coil component according to claim 6, wherein a lower surface of both ends of the internal electrode disposed at the highest position is disposed below an upper surface of a center portion of the internal electrode disposed at a second highest position in the cross section substantially parallel to the lamination direction of the laminate; and an upper surface of both ends of the internal electrode disposed at the lowest position is disposed above a lower surface of a center portion of the internal electrode disposed at a second lowest position in the cross section substantially parallel to the lamination direction of the laminate.

8. The laminated coil component according to claim 6, wherein a lower surface of both ends of the internal electrode disposed at the highest position is disposed below a lower surface of the center portion of the internal electrode disposed at the highest position in the cross section substantially parallel to the lamination direction of the laminate; and an upper surface of both ends of the internal electrode disposed at the lowest position is disposed above an upper surface of the center portion of the internal electrode disposed at the lowest position in the cross section substantially parallel to the lamination direction of the laminate.

9. A method for producing a laminated coil component comprising a laminate including first magnetic layers and second magnetic layers defined by a planar magnetic layer and a partial magnetic layer that are laminated and a coil disposed in the laminate and including a plurality of internal electrodes, the method comprising:

forming a coil forming layer by laminating the internal electrodes and the first magnetic layers;

forming the partial magnetic layer in an area that is on the principal surface of the planar magnetic layer and does not overlap with the internal electrodes in a lamination direction;

laminating the second magnetic layers to form a non-coil-forming layer; and pressure bonding a laminate formed of the coil forming layer and the non-coil-forming layer in the lamination direction.

* * * * *